United States Patent [19]

Itoh et al.

[11] Patent Number: 4,473,189

[45] Date of Patent: Sep. 25, 1984

[54] FUEL INJECTION VALVE, PARTICULARLY FOR DIESEL ENGINES

[75] Inventors: Katsuoki Itoh, Leonberg; Iwan Komaroff, Regensburg, both of Fed. Rep. of Germany

[73] Assignee: Robert Bosch GmbH, Stuttgart, Fed. Rep. of Germany

[21] Appl. No.: 416,591

[22] Filed: Sep. 9, 1982

[30] Foreign Application Priority Data

Oct. 8, 1981 [DE] Fed. Rep. of Germany ..... 3139949

[51] Int. Cl.[3] ..... B05B 1/32; F02M 61/20

[52] U.S. Cl. ..... 239/453; 239/583

[58] Field of Search ..... 239/453, 533.9, 583, 239/584; 251/65; 137/624.14

[56] References Cited

U.S. PATENT DOCUMENTS

| | | | |
|---|---|---|---|
| 2,667,895 | 2/1954 | Pool et al. | 251/65 X |
| 2,749,181 | 6/1956 | Maxwell et al. | 251/65 X |
| 2,901,185 | 8/1959 | Dickey | 239/453 |

FOREIGN PATENT DOCUMENTS

| | | | |
|---|---|---|---|
| 2093912 | 9/1982 | United Kingdom | 239/533.9 |

*Primary Examiner*—Andres Kashnikow
*Assistant Examiner*—Mary F. McCarthy
*Attorney, Agent, or Firm*—Frishauf, Holtz, Goodman & Woodward

[57] ABSTRACT

To provide a valve stroke or displacement characteristic with respect to closing force which is at first rapidly dropping and then, after a minimum closing force is reached again increasing, so that, as the valve needle reaches its final stroke, a hard impact is avoided and rapid closure of the valve, upon drop of injection pressure, will result, a magnet circuit (88) is established in the valve housing by a magnetic element (50) and an armature (66), one of the elements being seated in the housing and the other being coupled to the valve needle (18) to provide a closure force-versus-displacement characteristics which at first drops sharply and then flattens. Further magnetic elements formed by two magnets (70, 80), with like poles facing each other are provided, to furnish the closing force-versus-displacement characteristics which increases with increasing displacement, the composite of the two forces acting on the valve being in the form of a hanging curve (FIG. 2: 98) having a minimum ($F_6$) approximately midway along the length of the stoke of the valve needle (18).

12 Claims, 2 Drawing Figures

FUEL INJECTION VALVE, PARTICULARLY FOR DIESEL ENGINES

The present invention relates to fuel injection valves, and more particularly to fuel injection valve which is maintained normally in closed position, to open on the application of a fluid pressure pulse, for example the pressure injection pulse derived from the injection valve of a diesel engine controller.

BACKGROUND

Diesel engine fuel injection valves usually have a housing in which a needle valve is slideably located, the needle valve being held in closed condition under a closing force. The closing force may be obtained by springs, or by magnets. When a pressure pulse is applied to a fuel inlet of the valve, the needle element is lifted off the valve seat, counter the closing force, and fuel can be injected to the combustion chamber of a diesel engine.

The closing force usually is provided by a helical spring which, as well known, has an essentially linearly rising force-deflection characteristic. It has been proposed to change such a linear characteristic by adding a magnet in the valve structure so that a second operating force is applied thereto, the second operating force, provided by the magnet, having a characteristic that the closing force drops rapidly with distance of the valve element from the valve seat, so that the characteristic of the second closing force is, with respect to the movement of the valve element of the valve seat is first rapidly dropping and then flattening out. The composite force acting on the valve element, typically a valve needle, due to the interaction of the force derived from the helical spring and from the magnet will have a characteristic which, from a substantial initial value first drops rapidly and then, in a second half of the total movement of the valve needle away from the valve seat, rises essentially linearly to a final value, in essence in accordance with the characteristic of the helical spring. The final closing force value—to be overcome by the fluid pressure is, however, smaller than the initial closing force, which is formed by the combination of the magnet and the spring.

To have a different characteristic, is to have the closing force rise progressively up to, and, for some applications even exceeding the original closing force level when the valve element has reached its final open position. Such a characteristic permits closing of the valve even if the pressure of the fluid within the valve still pertains, so that the valve element can be returned to the valve seat rapidly and without delay. This is highly desirable to prevent carbonization, and carbon deposits at the nozzle opening. Upon opening of the valve, however, the rapidly decreasing force permits fast injection, which causes a rapid increase in quantity of fuel being injected—with respect to time, or opening distance of the valve element. This is desirable in operation of the engine, since the fuel consumption of the engine, for a given power output is thereby reduced.

It is extremely difficult to obtain a distance versus force characteristic as described when using spring elements without increasing the diameter of the valve housing, or of the overall valve structure. The diameter of the valve housing, however, should remain within standardized limits to permit association of the valve with existing engine structures, and to remain within available space on the engine cylinder blocks.

THE INVENTION

It is an object of the present invention to provide a fuel injection valve which has the above-referred to desirable operating characteristic in which the closing force of a valve element decreases rapidly, first, with opening movement and then, as the valve element approaches and eventually reaches its fully open end position, increases again in a closing direction, without increasing the thickness of the valve and maintaining existing dimensions, and which, further, is reliable and simple in construction.

Briefly, a magnet element is provided, associated with an armature element, the two elements being located in a tubular housing, in which one of the elements is seated in the housing and the other one is coupled to the valve needle, or valve operating component. Rather than using a helical spring to maintain the valve in its initially closed or seated position, however, the valve in accordance with the present invention includes additional magnetic means which have a force-displacement characteristic which is progressively increasing. One magnet element structure, thus, provides for a force-displacement characteristic which is rapidly decreasing—with respect to distance, the other a force-displacement characteristic which is rapidly increasing, so that the overall combined characteristic can be represented by a hanging curve, as illustrated in FIG. 2, curve 98, that is, with a first rapidly decreasing closing force and then a rapidly rising closing force, with a minimum at approximately half the distance of movement of the valve needle.

The structure has the advantage that the dimensions of the housing within which the slideable needle is located can be retained approximately the same as a housing which includes a spring-loaded valve needle, while providing a closing force-versus-valve movement characteristic which has a minimum approximately half-way of the stroke length of the valve element, and rapidly rises as the valve element opens completely.

The requirement for space can be reduced if one closing force, which also holds the valve closed under normal conditions is obtained by the interaction of two magnets, one of which being supported on the moveable valve element and the other within the housing, and so arranged that like poles of the magnet face each other, to provide a repulsion force, which acts to close the valve. These valve elements, in accordance with a feature of the invention, preferably are two ring-shaped permanent magnets located coaxially with respect to the valve needle.

The arrangement can be used particularly effectively in diesel engine injection valves which have a valve element which opens outwardly, also known as a A-nozzle. Fuel is supplied to the valve set by ducts located between the permanent magnet element and formed in the valve housing.

DRAWINGS

FIG. 1 is a simplified axial cross sectional view through a diesel engine injection valve with an outwardly opening valve needle; and FIG. 2 is a series of graphs of needle displacement (abscissa) versus closing force (ordinate) and illustrating force-displacement characteristics due to the magnets, and of the needle at overall.

DETAILED DESCRIPTION

Figure 1:
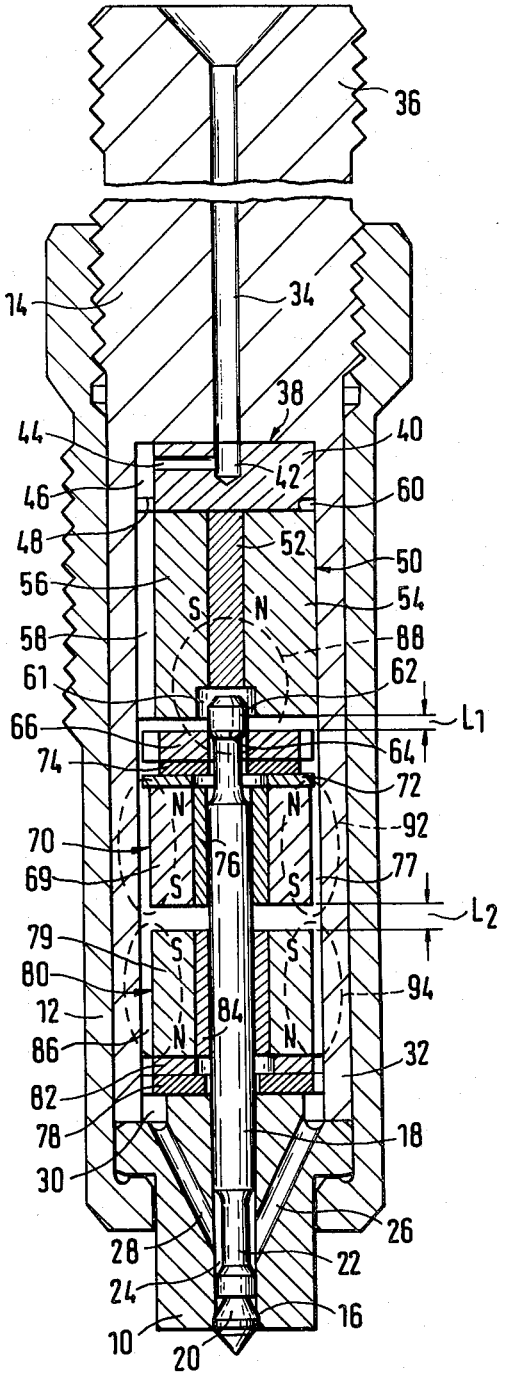

A valve body 10 is secured to a valve holder 12, forming a tubular body by a cover cap 14 formed with suitable threads and threaded into holder 12. The valve body 10 has a valve seat 16, and is formed with a bore in which a valve needle 18 is slideably guided, the valve needle 18 having a sealing cone 20 cooperating with the valve seat 16. Upstream of the sealing cone 20, a reduced section 22 is formed on the valve needle 18, leaving a ring-shaped space 24 within the guide bore for the valve needle. Ring-shaped chamber or space 24 is connected by bore 26, 28 to a central chamber 30 formed in the tubular extension 32 of the valve part 14.

A supply duct 34 is formed in the valve element 14. Duct 34 leads from a connection end 36 to the upper portion of the chamber 30, and terminates at the end wall 38 thereof. Chamber 30 has a disc 40 of non-magnetic material inserted therein. Disc 40 is formed with a blind bore extending centrally therein, and matching the supply bore 34 in part 14. A laterally outwardly extending connecting bore 44, formed as a cross bore in element 42 leads to an axially extending groove 46 located at the outer circumference of disc 40, which, in turn, communicates with a recessed circular surface 48 in the chamber 30. Grooves can also be placed in the upper end wall of the element 42, rather than the cross-bore 44; other ways of communicating fluid flow from the duct 34 into the chamber can be provided.

A magnet 50 is fitted against the disc 40. Magnet 50 is built up of a permanent magnet element 52 and two segmental pole pieces 54, 56 made of magnetizable material. The pole pieces 54, 56 which are fitted around the magnet 52 complete the physical outline of the overall magnet element 50 to form a cylinder with essentially circular cross-section, fitted without play, but without stress within the chamber 30. A longitudinal groove 58 is formed at the outer surface of the magnet 50 communicating with the recessed edge surface 48 of the disc 40 and the ring chamber 60 formed thereby to provide for fluid flow communication longitudinally within the chamber 30. A central recess 61 is formed at the lower end of the magnet 50.

The upper end of the valve needle 18 is formed as a head 62 which has an abutment of support surface 64. When the valve is closed, the head 62 fits into the recess 61 of magnet 50. A holder plate 66 is engaged against a support shoulder or abutment 64. A permanent magnet element 69 of a magnet, generally denoted a 70 is supported on the holder plate 66 via a magnetic plate 72 and a disc 74 made of non-magnetizable material. The permanent magnet element 69 is securely connected to a bushing 76, likewise of non-magnetic material and seated, essentially friction free on the valve needle 18. The outer diameter of the permanent magnet 69 is slightly smaller than the diameter of the chamber 30, thereby forming a ring-shaped gas 77 which provides for fluid flow communication within the chamber 30 between the two end faces of the magnet 70.

The upper end of the valve body 10, which defines the bottom wall of the chamber 30, has a disc 78 of non-magnet material applied thereto, against which the permanent magnet 79 of a magnet generally denoted by 80 is supported by a plate 82 of magnet materials. A bushing 84 of non-magnetic material securely supports the permanent magnet 79. The bushing 84, like the bushing 76 is in sleeve form, and made of non-magnetic material, essentially frictionless surrounding the valve needle 18. The outer diameter of the permanent magnet body 79, plate 82 and disc 78 is slightly smaller than the inner diameter of the chamber 30 so that fluid communication is established between the ring gap 86 formed thereby upstream and downstream of the end faces of the magnet 80.

OPERATION, WITH REFERENCE TO FIG. 2

Figure 2:
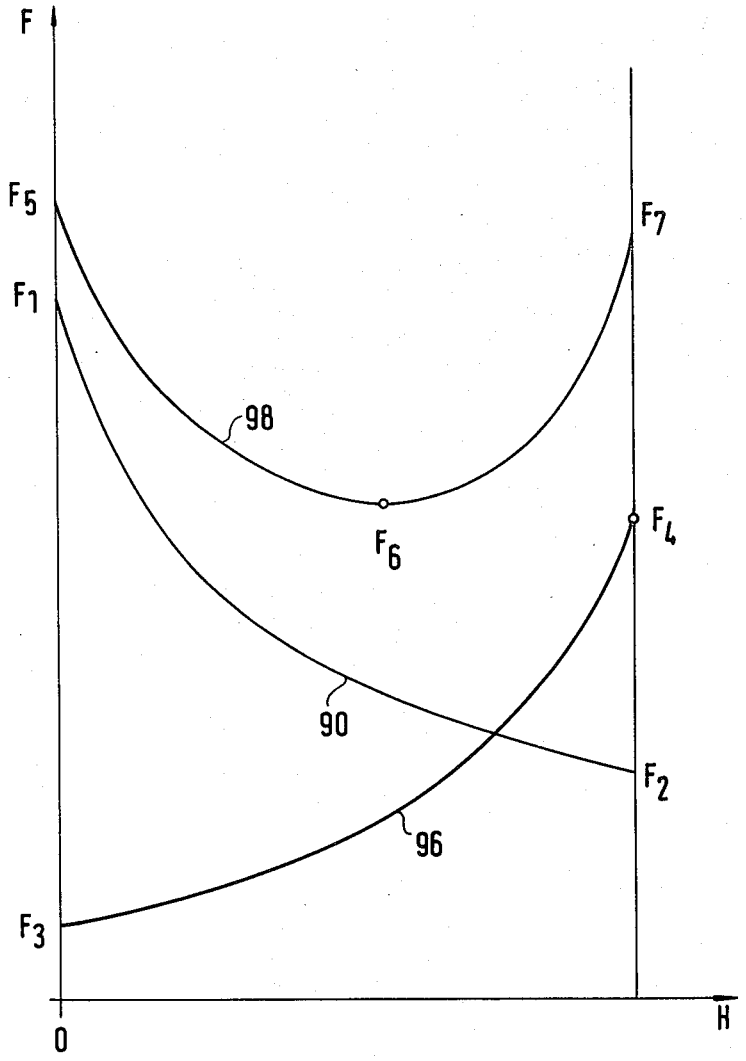

The holder plate 66 functions as the armature of the magnet 50. The magnet circuit is illustrated by broken lines 88, passing through the pole pieces 54, 56, holder plate 66 and the air gas $L_1$ between these parts. The valve is shown in FIG. 1 in its closed position, and thus magnet 50 applies its greatest attractive force to the holder plate 66 and over the holder plate 66 to the valve needle 18, so that the sealing cone 20 seats on valve seat 16. Upon application of fluid under substantial pressure to duct 34, the valve needle will be pressed downwardly in opening direction. The air gap $L_1$ will increase, causing, first, rapid decrease of the magnetic attractive force of holder plate 66 to the magnet 50 and subsequently smaller rate of decrease as the needle moves. FIG. 2 illustrates the force-distance relationship of the effect of magnet 50 by curve 90. As can be seen, the force, which is the base closing force starts from a high initial value $F_1$, with valve closed, drops rapidly and then ends at completely opened position of the valve at a terminal open value $F_2$, that is, at the terminal stroke of the valve needle 18.

The magnet circuits of the magnet 70, 80 are shown, respectively, by broken lines 92, 94. These magnet circuits extend over the tubular extension 32 of the valve holder 14 and over the respective adjacent plate 72, 82. Magnets 70 and 80 are so positioned that the facing end surfaces have the same polarity. The magnet force, thus, will be a repulsion force which, with increasing approach of the two magnets, increases consequentially. The force of magnets 70, 80 is shown in FIG. 2 by graph 96, which starts from a small initial value $F_3$, with the valve closed, and ends at a high final value $F_4$ at the end of the opening stroke of the needle, progressively increasing therebetween with the slope shown in FIG. 2. The repulsive force of the two like magnets tends to push the magnets from each other. Magnet 80 is supported on the valve body 10 and magnet 70 on the head 62 of the valve needle 18 by disc 72, 74 and 66, respectively. An air gap $L_2$ will result.

The forces applied by the magnets 50, 70 and 80 on the valve needle 18 combine to provide the resultant force illustrated in FIG. 2 at 98. From a high initial value $F_5$, the closing force drops to a minimum value $F_6$ approximately midway of the stroke and, at just the beginning of the second half of the stroke, rises then progressively to a final closing force value $F_7$, corresponding, roughly, to the initial value $F_5$.

Pressurized fuel supplied through the supply bore 34 to the valve body 14 passes through disc 40, longitudinal groove 58 in the magnet 50 and through the ring gaps 74, 86 and bores 26, 28 in the ring shaped space 24. As the fuel pressure increases, valve needle 18 is pushed outwardly to counter the resulting initial magnet force $F_5$, so that fuel can escape from the ring shaped space 24 through the valve seat 16, and sealing cone 20 into the combustion chamber of a Diesel engine. When the valve needle 18 is lifted off the seat 16, the resulting magnetic force drops rapidly. Thus, after an initially slightly delayed movement, the opening movement can proceed rapidly, and the decreasing magnetic force insures a rapid stroke movement of the valve needle in a direction of the opening thereof. In the second half of the stroke of the valve needle, the progressively increasing counterforce acts as a brake against the movement of the valve needle, thus preventing an abrupt impact of the valve needle at fully-open position.

As the fuel is injected, the substantial closing force $F_7$ acting thereon will rapidly retract the needle.

Various changes and modifications may be made within the scope of the inventive concept.

We claim:

1. Diesel fuel injection valve having
a tubular housing (12, 14);
a nozzle body (10) formed with a valve seat (16) secured to the housing;
a valve needle (18) having a valve cone (20) slideable in the housing;
fuel pressure duct means (34-46-58-77-86-30-28-26-24) extending through the body and shaped to apply a lifting force, when subjected to pressurized fuel, on the valve needle;
and force generating means operatively coupled to the valve needle to apply two closing forces (FIG. 2; 90, 96) on the needle valve including
means providing a first (96) of the closing forces having a force-versus-displacement characteristic which is increasing with increasing displacement,
and means providing a second (90) of the closing forces having a characteristic which at first drops sharply and then flattens, comprising
a magnetic element (50; 52, 54, 56) and an armature element (66) located in the tubular housing, one of said elements being seated in the housing and the other of said elements being coupled to the valve needle (18);
wherein, in accordance with the invention, the means providing said one of the closing forces comprises magnetic means (70, 18) having a force-versus-displacement characteristic (96) which is progressively increasing to provide a resultant, combined force-versus-displacement characteristic which, upon opening movement of the valve needle, is first rapidly decreasing to a minimum value and then again increasing to provide, at the terminal end of the stroke of the valve needle, a force counter the opening of the valve needle and thereby preventing hard impacts of the valve needle at the terminal end of its stroke and providing for rapid reclosing of the valve.

2. A Diesel Fuel injection valve according to claim 1 wherein said magnetic means having said progressively increasing characteristic comprises
two magnets (70, 80), one of said magnets (70) being operatively coupled to the valve needle (18) and the other of said magnets (80) being seated within the valve housing.

3. A Diesel fuel injection valve according to claim 2 wherein said magnets (70, 80) are located within the valve housing with like poles facing each other to provide for a repulsion force between said magnets.

4. A Diesel fuel injection valve according to claim 2 wherein said magnets (70, 80) comprise ring-shaped permanent magnet elements (69, 79), located coaxially with respect to the valve needle (80).

5. A Diesel fuel injection valve according to claim 4 wherein the valve needle is an outwardly moving valve needle;
and said pressure fuel duct means includes ducts (77, 86), located between the magnets (70, 80) and the inner wall of the valve housing (14) and the valves (16, 20) defined by the valve needle and the nozzle body.

6. A Diesel fuel injection valve according to claim 1 wherein, in a closed position of the valve, the magnet element (50) provides for closing force which is less than the closing force provided by the magnetic means when the valve is in fully opened position;
and the closing force reverses direction approximately midway of the displacement or stroke of the valve needle (18).

7. A Diesel fuel injection valve according to claim 1 wherein the magnet element (50) is seated in the tubular housing, and the armature element (66) is coupled to the valve needle (18) said armature element and magnet element forming an interacting magnetic circuit tending to keep the valve closed with a force substantially higher than the force required during opening of the valve and the magnetic means providing a closing force when the valve is open, which is higher than the force applied on the valve needle when the valve is closed.

8. Diesel fuel injection valve having
a tubular housing (12, 14);
a nozzle body (10) formed with a valve seat (16) secured to the housing;
a valve needle (18) having a valve cone (20) slideable in the housing;
fuel pressure duct means (34-46-58-77-86-30-28-26-24) extending through the body and shaped to apply a lifting force, when subjected to pressurized fuel, on the valve needle;
and force generating means operatively coupled to the valve needle to apply two closing forces (FIG. 2; 90, 96) on the needle valve including
means providing a first (96) of the closing forces having a force-versus-displacement characteristic which is increasing with increasing displacement,
and means providing second (90) of the closing forces having a characteristic which at first drops sharply and then flattens, comprising
a magnetic element (50; 52, 54, 56) and an armature element (66) located in the tubular housing, one of said elements being seated in the housing and the other of said elements being coupled to the valve needle (18);
wherein, in accordance with the invention
the means providing said one of the closing forces comprises two magnets (70, 80), one of said magnets (70) being operatively coupled to the valve needle (18) and the other of said magnets (80) being seated within the valve housing, said magnets (70, 80) being located within the valve housing with like poles facing each other to provide for a repulsion force between said magnets, said magnets providing a force-versus-displacement characteristic (96) which is progressively increasing to provide a resultant, combined force-versus-displacement characteristic which, upon opening movement of the valve needle, is first rapidly decreasing to a minimum value and then again increasing to provide, at the terminal end of the stroke of the valve needle, a force counter the opening of the valve needle and thereby preventing hard impacts of the valve needle at the terminal end of its stroke and providing for rapid reclosing of the valve.

9. A Diesel fuel injection valve according to claim 8 wherein said magnets (70, 80) comprise ring-shaped permanent magnet elements (69, 79), located coaxially with respect to the valve needle (80).

10. A Diesel fuel injection valve according to claim 9 wherein the valve needle is an outwardly moving valve needle;

and said pressure fuel duct means includes ducts (77, 86), located between the magnets (70, 80) and the inner wall of the valve housing (14) and the valves (16, 20) defined by the valve needle and the nozzle body.

11. A Diesel fuel injection valve according to claim 8, wherein, in a closed position of the valve, the magnet element (50) provides for closing force which is less than the closing force provided by the magnetic means when the valve is in fully opened position;

and the closing force reverses direction approximately midway of the displacement or stroke of the valve needle (18).

12. A Diesel fuel injection valve according to claim 8, wherein the magnet element (50) is seated in the tubular housing, and the armature element (66) is coupled to the valve needle (18) said armature element and magnet element forming an interacting magnetic circuit tending to keep the valve closed with a force substantially higher than the force required during opening of the valve and the magnetic means providing a closing force when the valve is open, which is higher than the force applied on the valve needle when the valve is closed.

* * * * *